US010995469B1

(12) United States Patent
Kimble et al.

(10) Patent No.: US 10,995,469 B1
(45) Date of Patent: May 4, 2021

(54) QUICK COUPLER

(71) Applicants: Allen E. Kimble, Rock Spring, GA (US); Tracy C. Errera, Chattanooga, TN (US)

(72) Inventors: Allen E. Kimble, Rock Spring, GA (US); Tracy C. Errera, Chattanooga, TN (US)

(73) Assignee: TAG Manufacturing, Inc., Chattanooga, TN (US)

( * ) Notice: Subject to any disclaimer, the term of this patent is extended or adjusted under 35 U.S.C. 154(b) by 596 days.

(21) Appl. No.: 15/938,905

(22) Filed: Mar. 28, 2018

Related U.S. Application Data

(60) Provisional application No. 62/481,450, filed on Apr. 4, 2017.

(51) Int. Cl.
*E02F 3/36* (2006.01)

(52) U.S. Cl.
CPC ..... *E02F 3/3622* (2013.01); *E02F 3/364* (2013.01); *E02F 3/3636* (2013.01); *E02F 3/3659* (2013.01); *E02F 3/3663* (2013.01)

(58) Field of Classification Search
CPC ..... E02F 3/3622; E02F 3/3627; E02F 3/3636; E02F 3/3631; E02F 3/364; E02F 3/3659; E02F 3/3663
See application file for complete search history.

(56) References Cited

U.S. PATENT DOCUMENTS 3,818,551 A * 6/1974 Coughran, Jr. ..... B62D 49/02 403/24
5,147,173 A * 9/1992 Fauber ..... E02F 3/3627 172/273
5,263,810 A * 11/1993 Takekata ..... E02F 3/3627 403/322.3
5,692,850 A * 12/1997 Kimble ..... B66F 9/12 172/273
6,533,528 B2 * 3/2003 Degen ..... E02F 3/3631 172/272
6,691,438 B2 * 2/2004 Fatemi ..... E02F 3/3627 37/403
6,866,467 B2 * 3/2005 Dvorak ..... E02F 3/3663 37/468
6,886,279 B2 * 5/2005 Kimble ..... E02F 3/3631 37/468
7,182,546 B1 * 2/2007 Kimble ..... E02F 3/3631 37/468
7,225,566 B1 * 6/2007 Kimble ..... E02F 3/3627 37/403
7,337,564 B2 * 3/2008 Kimble ..... E02F 3/3631 37/468

(Continued)

*Primary Examiner* — Jonathan P Masinick
(74) *Attorney, Agent, or Firm* — Miller & Martin PLLC; Stephen J. Stark

(57) ABSTRACT

A quick coupler provides a way to securely lock implements to the coupler utilizing a design which receives hooks at connection locations and then directs pins into pockets at a rear of the implement. Instead of directing the pins along a pocket axis (as is done in the prior art), the pins are directed at an angle relative to the pocket axis thereby securely connecting the coupler to the implement. In fact some embodiments can have a pin extension system spaced from a wedge plate surface defining the pocket of the implement.

19 Claims, 3 Drawing Sheets

(56) References Cited

U.S. PATENT DOCUMENTS

| | | | | |
|---|---|---|---|---|
| 7,654,019 | B2 * | 2/2010 | Yeager | E02F 3/3663 37/468 |
| 7,654,787 | B2 * | 2/2010 | Sonerud | E02F 3/3663 414/723 |
| 7,814,689 | B2 * | 10/2010 | Vering | E02F 3/364 37/468 |
| 7,836,616 | B2 * | 11/2010 | Esser | E02F 3/3663 37/468 |
| 7,882,898 | B1 * | 2/2011 | Vering | E02F 3/3627 172/272 |
| 8,833,480 | B2 * | 9/2014 | Grimes | E02F 3/3631 172/272 |
| 9,121,162 | B1 * | 9/2015 | Kimble | E02F 3/96 |
| 2012/0237292 | A1 * | 9/2012 | Seda | E02F 3/3636 403/376 |
| 2015/0233084 | A1 * | 8/2015 | Seljestad | B66F 9/12 414/723 |

* cited by examiner

QUICK COUPLER

CLAIM OF PRIORITY

This application claims the benefit of U.S. Provisional Application No. 62/481,450 filed Apr. 4, 2017, which is incorporated herein by reference in its entirety.

FIELD OF THE INVENTION

The present invention relates to quick couplers for use with coupling two bodies together, and in particular to quick couplers for use in joining implements, i.e., buckets, pallet forks and the like, to construction machinery, such as wheel loaders, track loaders, backhoe loaders, and similar machines.

BACKGROUND OF THE INVENTION

Loaders of various kinds are used in various industries including construction, such as site preparation or other tasks, mining and other industries. Implements can be mounted onto the end of an arm to perform work. Buckets are certainly one common implement attached to loaders. Forks are another. Other implements also exist in the marketplace. By providing a quick coupler, an operator can relatively quickly remove one implement from the loader and attach another.

Quick couplers have evolved over time. At one point, couplers were not particularly quick and utilized pins that were not easy to remove to switch implements. Operators had to manually remove pins, remove the implement, locate a new implement in a correct relationship relative to the coupler and then reinstall the pins. This process proved to be laborious. A profound evolution occurred with the first generation of quick couplers which allowed the operator to control the coupler from the cab of the loader. The operator could provide a command (usually hydraulic in nature) to withdraw a pin to release at least a portion of an implement so that the implement could then be removed, possibly by moving the arm to disengage the implement at another location. The process could then be reversed to connect the next implement.

Caterpillar corporation created an innovative quick coupler that has received wide acceptance in the marketplace with U.S. Pat. No. 7,882,898 for the coupler and U.S. Pat. No. 7,814,689 for the implements. While this combination of quick coupler and implements has been well received in the marketplace, the combined wedging action of the coupler with the implements is believed to cause wear over time on wedge surfaces. Accordingly, the applicant believes that a need exists to provide a quick coupler to the marketplace which can accept existing or newly constructed implements, and in many applications, without engaging a wedge coupling surface of the implements.

Accordingly, a need exists for an improved quick coupler in the marketplace.

SUMMARY OF THE INVENTION

It is a present object of the present invention to provide an improved quick coupler.

It is another object of the present invention to provide a quick coupler which can cooperate with existing implements in the marketplace while connecting in a different manner than those implements were originally designed for connection.

Accordingly, a quick coupler can be provided which connects to a first body, such as a loader by providing a tube configured to be received by hooks of a second body (i.e., an implement). The second body also has a wedge plate extending from a rear of the body below the hooks with a pocket there through. The quick coupler has a hydraulic cylinder which can drive a pin into the pocket without contact with a wedge coupling surface of the implement. In fact, by changing the angular relationship of the hydraulic cylinder relative to a center bore of the pocket, the extension of the pin can preferentially tighten a grip on an implement when connected with further extension of or pressure exerted by the pin. The angular relationship of a surface through which the pin passes and a line extending through that surface through a center of the tube is preferably greater than 60 degrees, if not at least 65 degrees, 70 degrees or possibly even closer to 90 degrees. In the specification of the '878 patent, being closer to 90 degrees creates a situation whereby surfaces of that design wedge together too tightly. The applicant has avoided such a problem by removing contact with the wedge coupling surface of the implement to avoid such a situation. This angular relationship of having a pin axis not be collinear with an axis of the pocket allows the pin to wedge into the pocket to hold the coupler tight to the implement for at least some embodiments.

Instead of having a wedge coupling surface of the coupler contact a corresponding wedge coupling surface of an implement, the applicant's design has at least one of first and second stops which can contact portions of an implement. Specifically, a first stop, if utilized, can be toward a front of the coupler and preferably contact a rear of an implement such as a bucket. Meanwhile as second stop, if utilized, can contact another portion of the implement, such as a rear face of the wedge plate (in a non-wedging manner). At least one of the first and second stops position an extendable pin in linear relationship with a pin pocket formed through the wedge plate of the implement.

The coupler does not have a wedge coupling surface, and certainly not one between 60 and 44 degrees relative to a line passing through any such surface and a center of a tube of the coupler. In fact, no structure of the applicant's design contacts the wedge coupling surface of the implement as required by the'898 patent. Instead, the applicant's quick coupler has at least one of first and second stops. Should one examine an angle between a plane of contact of the stops with the implement and a line passing through a center of a connection tube and a wedge pocket, one would discover angles of less than 15 degrees, if not less than 10 or 5 degrees. When describing the criticality of angular relationship in the '898 patent, the patentee, when selecting their angular relationship range of 60-44 degrees, stated that if the angle were too close to 0 degrees, then there will not be adequate wedging action to force the surface tightly together and create a tight fit. The applicant does not force wedge coupling surfaces together in an effort to create a tight fit as provided by the design of the '898 patent. Instead, a less wear intensive connection can be provided.

With at least one of the first and second stops contacting the implement, the pin is located above the pin pocket formed in a wedge plate. The pin can then be extended along a pin axis (without any contact with a wedge coupling surface of an implement) to enter into the pocket of the wedge plate to then retain the implement to the coupler. The pin axis forms an angle with a line extending through a center of the tube and a surface surrounding the pin at an angle less than 30 degrees if not closer to zero degrees.

This innovative construction provides a way for companies to utilize a quick coupler other than those provided by the owner of the '898 patent to utilize existing implements in the marketplace.

BRIEF DESCRIPTION OF THE DRAWINGS

The accompanying drawings illustrate the preferred embodiments of the invention and, together with the description, serve to explain the invention. These drawings are offered by way of illustration and not by way of limitation.

DETAILED DESCRIPTION OF THE PREFERRED EMBODIMENT

Figure 1:
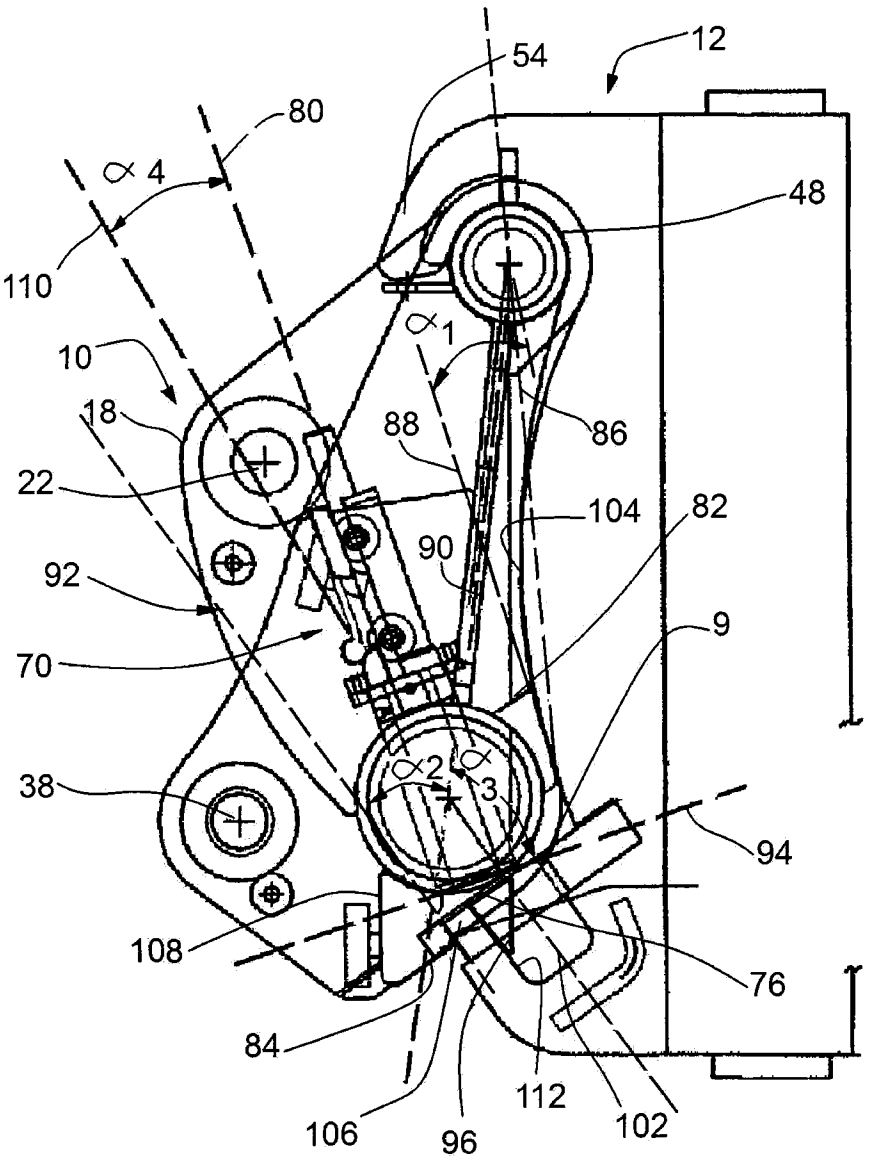
FIG. 1 is a side plan view of a presently preferred embodiment of the present invention connected to an implement.
Figure 2:
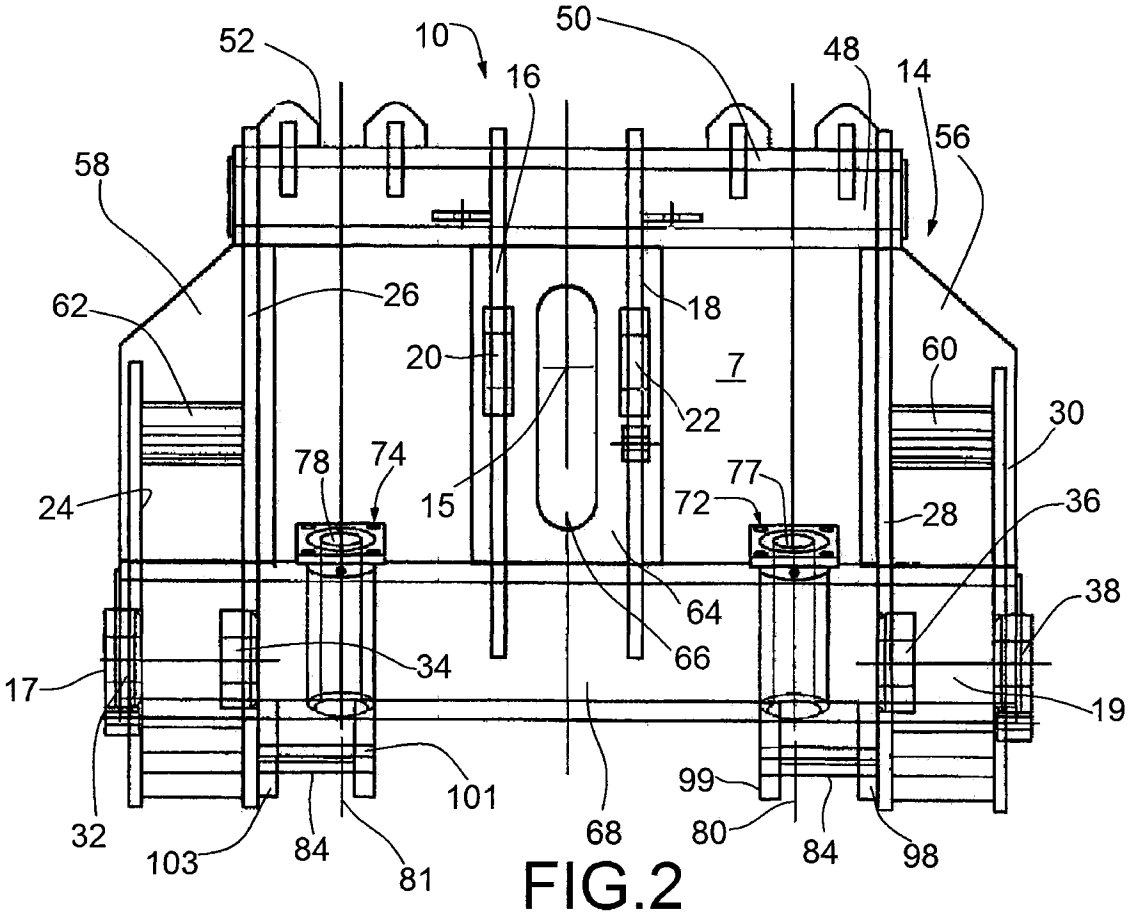
FIG. 2 is a rear plan view of the embodiment shown in FIG. 1 without hydraulics and without being connected to an implement.

FIG. 1 shows a quick coupler 10 connected to an implement 12 in the form of a bucket. Other implements could take other forms whether they be forks or other implements known or developed in the art to be utilized by various loader style arms.

Quick coupler 10 has a frame 14 having first and second center plate members 16,18 with first and second bores 20,22 (illustrated as aligned along a first axis 15) there through, respectively. First and second bores 20,22 may receive a first connection pin 21 (shown in FIG. 3) operably coupled to the frame and an arm 40 of a machine 42 (such as a loader, excavator, etc.). First and second sets of plate members (comprised of first and second and third and fourth, plate members, respectively) 24,26,28,30 have bores (third, fourth, fifth and sixth) 32,34,36,38 (illustrated as aligned, respectively along second and third axes 17,19 with the sets) there through for receiving two second connection pins 37 (one of which is obscured from view) to an arm 40 of a machine 42, such as a loader of various types or other equipment. Arm 40 has first and second arm members 44,46 so as to be able to rotate the implement as would be known in the art and take on various different constructions based on the type and manufacturer of the machine 42 (along with the quick coupler 10). One of the arm members 44,46 connects to the first connection pin 21, the other to the second connection pins 37 in the illustrated embodiment with the pins 21,37 operably coupled to the frame 14. The frame 14 can take various forms to accommodate various arms 40.

First member 48 (illustrated as a tube member) is normally located towards a top of the coupler 10 above the first and second bores 20,22. While a single tube member 48 is shown, it provides connection locations 50,52 for receiving at least two hooks 54 (one of which is shown) from an implement. The tube member 48 can extend between plate members 26,28 with plate members 16,18 connecting at intermediate locations between plate members 26,28. External to plate members 26,28 can be plate members 24,30 which can be connected to plate members 26,28 with front plates 56,58, shoulders 60,62 which could be tube portions or other connection techniques so as to locate bores 32,34 and 36,38 in appropriate locations.

Figure 3:
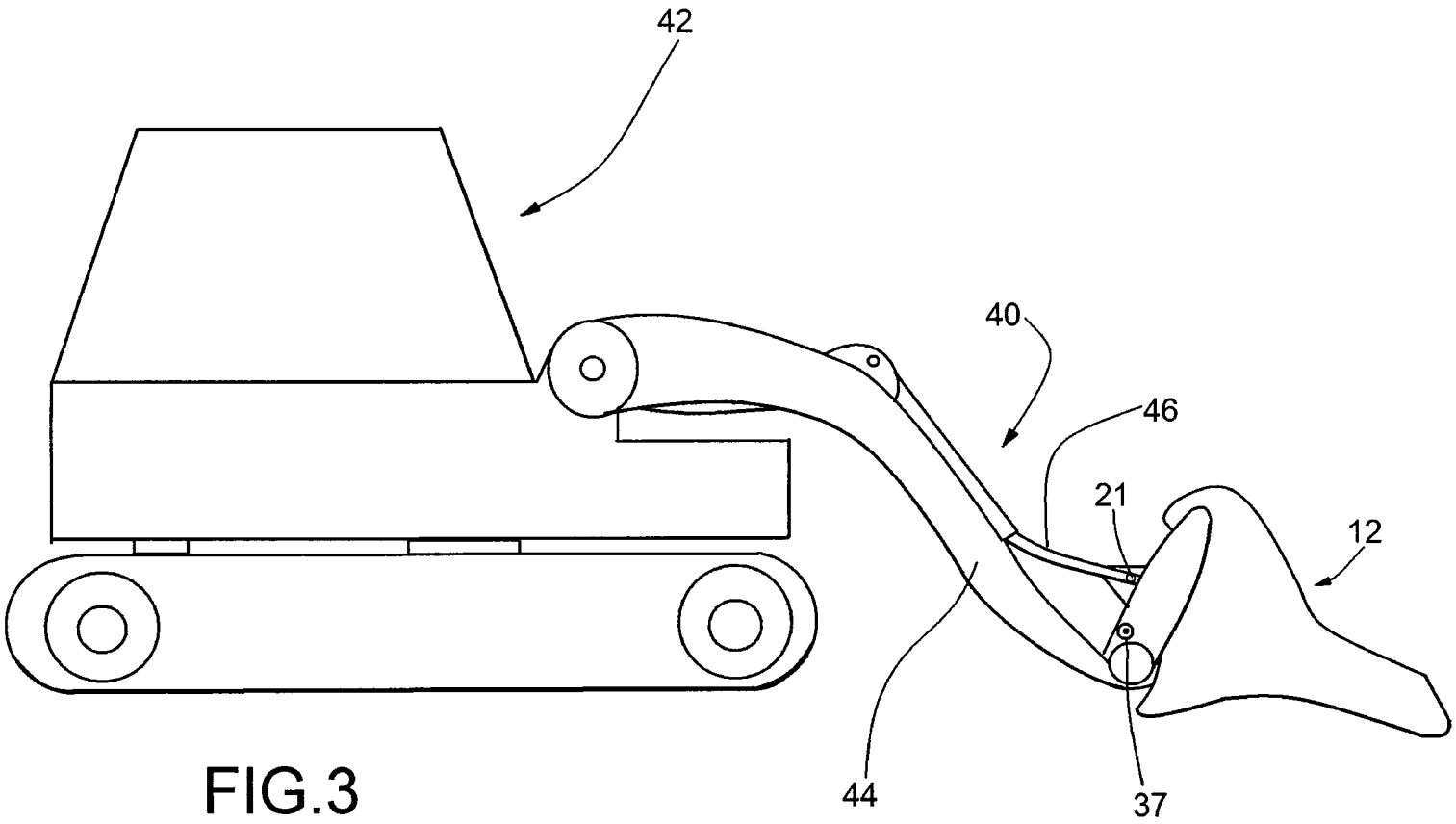
FIG. 3 is a side plan view showing the preferred embodiment of FIGS. 1 and 2 connected to a loader.

Meanwhile center plate 64, possibly having window 66 there through, may connect to center plate members 20,22. With the bores 20,22 and 32,34 as well as 36,38 properly located to connect to a particular arm 40 of a machine 42 with pins 21,37 and/or others, the coupler 10 can connect to an implement such as implement 12 (a bucket is shown in FIG. 3, but other implement types as known in the art may be connected as well). A second tube member 68 can also connect to any, or all, of the vertically extending plate members 24,26,20,22,28,30 to provide a location to connect and support pin extension systems 70 at mounts 72,74. Second tube member 68 can be parallel to first tube member 48. Any, or all, of the plate members 16, 18, 24,26, 28, 30 can be parallel to one another and can extend perpendicular relative to back 7.

Pin extension systems 70 may be hydraulic, pneumatic, electro mechanical or have other motive forces to move a retention pin 76 in and out of a pocket 102 of the implement 12. The pin extension systems 70 are operably coupled to the frame 14 and directs respective retention pins 76 through bores 77,78 through the tube 68 so that retention pins 76 can extend along pin axes 80,81 into spaced apart pockets 102 of the implement such as are shown as 320a and 320b in FIG. 6 of U.S. Pat. No. 7,882,898 (which is incorporated by reference herein in its entirety).

Pins 76 extend in and out of the pockets 102 along pin axis 80 between a connected and a disconnected configuration as controlled by an operator of the machine 42 as would be understood by those of ordinary skill in the art. When the tube member 48 grabs the hooks 54 of the implement 12 as shown in FIG. 1, the coupler 10 can be rotated using the arm portions 44,46 until at least one of first and second stops 82,84 contacts the implement 12 as will be discussed below. This location locates the retention pins 76 above the respective pockets 102 (in a disconnected configuration) so that the retention pins 76 can be inserted therein to secure the coupler 10 to the implement 12. Reversing the process can release the implement 12 so that another one may be connected to the coupler 10. The angular relationship of the retention pins 76 relative to the pockets 102 and the wedge plates 106 of the implement will also be discussed below. When in the disconnected configuration, the retention pins are retracted along the pin axes out of engagement with the pockets 102.

First stop 82, if utilized, preferably contacts a rear face 104 of the implement 12 forward of the pocket(s) 102. Second stop 84, if utilized, preferably contacts a rear face 108 of the wedge plate 106 (rearwardly of the pocket(s) 102). Both or either of first and second stops 82,84 are operably coupled to the frame 14 if utilized. No constructions similar to a second stop 84 are known in the prior art. The first and/or second stops 82,84 prevent the coupler 10 from contacting an upper surface of the wedge plate 106 by spacing by a gap 9. Using at least one, or both, of the first and second stops 82,84 prevents the coupler 10 from working like the coupler of the '898 and '689 patents which have cooperating wedge coupling surfaces of the coupler and the implement which engage one another at a specific angular relationship of between 44 and 60 degrees.

The angular relationships of the '898 and '689 patents are relatively easy to evaluate. Using similar techniques applied to the coupler 10, very different results are obtained. First line 86 between a center of the tube 48 and first stop 82 taken relative to a line 88 extending through the contact surface 104 at the first stop 82 provides an angle $\alpha 1$ less than 10 degrees. Second line 90 extending between a center of the tube 48 and second stop 84 taken relative to a line 92 extending through contact surface 108 provides an angle α2 of less than 35 degrees. Both α1 and α2 are oppositely oriented relative to the angle α shown in the '898 and '689 patents, so as it relates to those angular relationships, angles α1 and α2 are really less than −10 and −35 degrees.

While the above discussion solves almost all of the issues related to the '898 and '689 patents, another angular relationship can be evaluated relative to the bore 77 at a bottom of tube 68 relative to a line extending from the center of tube 48 to an edge of bore 77 which happens to coincide with second line 90 (by coincidence). This line is then evaluated relative to a line extending through the bore 77 where it exits the pipe 68 which can be described as third line 94. Third line 94 and second line 90 have an angle α3 of at least 65, if not 70 or more degrees (and could extend up to 90 degrees or more in various embodiments). Thus, no matter how one evaluates the claims of the '898 and '689 patents relative to the coupler 10, the structure is outside the claimed angular relationships.

With the applicant finding a design which does not infringe the '898 and '689 patents, a new market emerges which needs to be protected. Specifically, the applicant uses, for at least some embodiments, a bottom or second tube 68 to support pin extension systems 70. The tube 68 of a preferred embodiment is constructed and located in such a way as to not contact wedge contact surfaces of wedge plates 84 by being spaced above the pockets 102 in the connected configuration, but is instead spaced above the wedge plate 106. The spacing can occur using at least one, if not both, of first and second stops 82,84. The tube structure is also believed to be a more economical structure than the box structure of the prior art.

The pin axis 80 of the pin extension systems 70 is preferably angularly oriented relative to a pocket axis 110, such as at least about 5-10 degrees, if not 20, 30 or even 35 degrees or more for some applications. See angle α4. Pin 76 has an angled face 96 which can apply pressure inside the pocket 102 to a sidewall (illustrated as a rear wall 112) of the pocket 102 to maintain tight engagement of the coupler 10 to the implement 12 (the angled face 96 has an angle of about 5-35 degrees relative to the pin insertion axis 80 for many embodiments). As the pin 76 wears, it may extend further into the pocket 102 for some embodiments. The pin extension systems 70 can be easily replaced by removing from the mounts 72,74 and servicing and/or replacing. This angular relationship is believed to be novel. Pockets 102 can be openings in wedge plate 106 or separate wedge plates 106 and may be slot-like (like a channel) or have a perimeter defining the opening in various embodiments. Openings/pockets 102 of many embodiments have a side wall, such as a rear wall against which the insertion axis 80 of the retention pins 76 contacts and intersects in the connected configuration. For many embodiments, the pocket(s) 102 are formed in, through, or are at least partially defined by, one or more wedge plates 84. Also for many embodiments, the pin insertion axes 80 are non-colinear with a pocket or opening axis 110 as defined as extending perpendicularly to wedge plate(s) 84 at the openings o pockets 102.

The bottom tube 68 is also much easier to provide than forming up of a box as is done in the prior art. Providing bores 77,78 through the tube to accommodate the pin extension systems 70 is also relatively believed to be novel. The bores 77,78 need not necessarily pass through a center of the bottom tube 68 for all embodiments.

The second stop 84 contacts the wedge plate 106 of the implement 12, if utilized. Feet 98,99 and 101,103 may have respective second stops 84 connected thereto. The feet 98,99 and 101,103 may connect to the bottom tube 68, if utilized. Second stops 84 can then span respective feet 98,99 and 101,103.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A quick coupler comprising:

a frame having first and second center plate members with first and second bores aligned along a first axis, respectively, and first and second sets of plate members having third and fourth bores aligned along a second axis, and fifth and sixth bores aligned along a third axis, respectively; at least one member providing first and second connection locations for receiving two hooks of an implement;

first and second retention pins operably coupled to the frame and respectively movable between an extended and a retracted position along pin insertion axes by pin extension systems between a connected and a disconnected configurations, wherein when in the connected position, the retention pins proceed into pockets of the implement with the pin insertion axis intersecting a rear wall defining the pockets and parallel to a pocket axis and the insertion pins contacting the rear walls of the pockets in the connected configuration with the pin extension system spaced apart by a gap above an upper surface of the pockets in the connected configuration, and when in the disconnected configuration, said insertion pins retracted along the pin insertion axes out of engagement with the pockets, said pin insertion axis angled between 5 and 25 degrees relative to the pocket axis.

2. The quick coupler of claim 1 in combination with a machine, said machine having an arm connected to the quick coupler with a first connection pin extending through the first and second bores and second connection pins extending through the third and fourth bores, and fifth and sixth bores, respectively.

3. The quick coupler of claim 2 wherein the arm has first and second arm members, with the first connection pin connecting to the first arm member and the second connection pins connecting to the second arm member.

4. The quick coupler of claim 1 further comprising a first tube member, and the first and second connection locations are located along the first tube member and the first tube member is located above the first and second bores.

5. The quick coupler of claim 1 wherein the first and second sets of plates comprise first and second and third and fourth plates respectively, said second plate located between the first plate and the first center plate and the third plate located between the second center plate and the fourth plate, the first connection location located between the second plate and the first center plate, and the second connection location located between the second center plate and the third plate.

6. The quick coupler of claim 1 further comprising a second tube member extending between the second and third plates, the second tube member connected to and supporting the pin extension systems.

7. The quick coupler of claim 6 wherein the first and second tube members are parallel.

8. The quick coupler of claim 1 wherein the pin extension systems are one of hydraulic, pneumatic, and electro-mechanical.

9. The quick coupler of claim 1 further comprising at least one of first and second stops operably coupled to the frame, said at least one of the first and second stops contacting a portion of the implement when in the connected configuration while spaced apart from the pockets of the implement.

10. The quick coupler of claim 9 comparing both the first and second stops and wherein the first stop contacts the implement forward of the pocket and the second stop contacts the implement rearwardly of the pocket.

11. The quick coupler of claim 10 wherein the second stop contacts a rear of a wedge plate, said wedge plate at least assisting in defining one of the pockets.

12. The quick coupler of claim 9 wherein the implement has a wedge plate at least assisting in defining one of the pockets and the wedge plate is spaced by a gap above the pockets from the pin extension system when in the connected configuration.

13. The quick coupler of claim 1 wherein the pins have an angled surface relative to the pin insertion axis.

14. The quick coupler of claim 13 wherein the angled surface is angled at an angle between about 5 and 35 degrees relative to the pin insertion axis.

15. The quick coupler of claim 1 wherein the center plates are parallel.

16. The quick coupler of claim 1 wherein the first, second, third and fourth plates are parallel.

17. The quick coupler of claim 1 in combination with an implement, said implement connected to the quick coupler in the connected configuration.

18. A quick coupler for use with an implement having at least one opening in a wedge plate receiving pins of the quick coupler, said quick coupler comprising:

a frame having first and second center plate members with first and second bores aligned along a first axis, respectively, and first and second sets of plate members having third and fourth bores aligned along a second axis, and fifth and sixth bores aligned along a third axis, respectively; at least one member providing first and second connection locations for receiving at least two hooks of an implement;

pins operably coupled to the frame and respectively movable between an extended and a retracted position along pin insertion axes by pin extension systems between a connected and a disconnected configurations, wherein when in the connected position, the pins proceed into the at least one opening of a wedge plate of the implement along the pin insertion axes, said pin insertion axes non-collinear with opening axes extending perpendicular to the openings relative to the wedge plate and the pin insertion axis angled between 5 and 35 degrees relative to the opening axis.

19. The quick coupler of claim 18 wherein the retention pins proceed into the openings of the implement with the pin insertion axis intersecting a rear wall defining the openings and the insertion pins contacting the rear walls defining the openings in the connected configuration, and when in the disconnected configuration, said insertion pins retracted along the pin insertion axes out of engagement from the implement, and the pin extension system is spaced by a gap from the wedge plate in the connected configuration.

* * * * *